United States Patent [19]

Gray

[11] Patent Number: 4,635,938

[45] Date of Patent: Jan. 13, 1987

[54] BOARD GAME

[76] Inventor: Patrick Gray, 13A Hasbrouck Rd., Garnerville, N.Y. 10923

[21] Appl. No.: 843,251

[22] Filed: Mar. 24, 1986

[51] Int. Cl.[4] ..... A63F 3/00

[52] U.S. Cl. ..... 273/274; 273/146

[58] Field of Search ..... 273/146, 274

[56] References Cited

U.S. PATENT DOCUMENTS

| | | | |
|---|---|---|---|
| D. 29,532 | 10/1898 | Woglom | 273/146 X |
| 1,030,554 | 6/1912 | Wharton | 273/146 |
| 2,151,030 | 3/1939 | Hinson | 273/137 |
| 3,208,754 | 9/1965 | Sieve | 273/146 |
| 3,868,115 | 2/1975 | Faiferlick | 273/146 |
| 3,905,603 | 9/1975 | Hoetzel | 273/138 R |
| 4,247,114 | 1/1981 | Carroll | 273/274 |
| 4,309,038 | 1/1982 | Spoon | 273/428 |
| 4,312,508 | 1/1982 | Wood | 273/274 |
| 4,334,685 | 6/1982 | Robbins et al. | 273/274 |

FOREIGN PATENT DOCUMENTS 1221721 1/1960 France .

*Primary Examiner*—Harland S. Skogquist

*Attorney, Agent, or Firm*—Charles E. Temko

[57] ABSTRACT

A dice game using three dice of tetrahedron type, two of said dice being colored white and the third die having four colors on separate surfaces, each colored surface having a differing numerical value as well. The play is commenced by first rolling the two white dice to obtain a numerical value of one of ten possibilities upon which first bets have been placed. The second roll utilizes the third colored die to determine the remainder of the wagering which include: odd/even, hard three, six, nine, and twelve; the total numerical value of the three dice, the listed numbers shown on each die, and the color and number of the third die.

2 Claims, 3 Drawing Figures

BOARD GAME

SUMMARY OF THE INVENTION

Briefly stated, the invention contemplates the provision of a set of three quadrahedral type dice, two of which are colored white and are employed for numerical value only. The third die includes both numerical values and a separate and distinct color associated with each numerical value. The first two mentioned dice are utilized during a first roll of the dice and the third die is used alone for a second roll.

BRIEF DESCRIPTION OF THE DRAWING

Within the drawing, to which reference will be made in the specification.

DETAILED DESCRIPTION OF THE DISCLOSED EMBODIMENT

Figure 1:
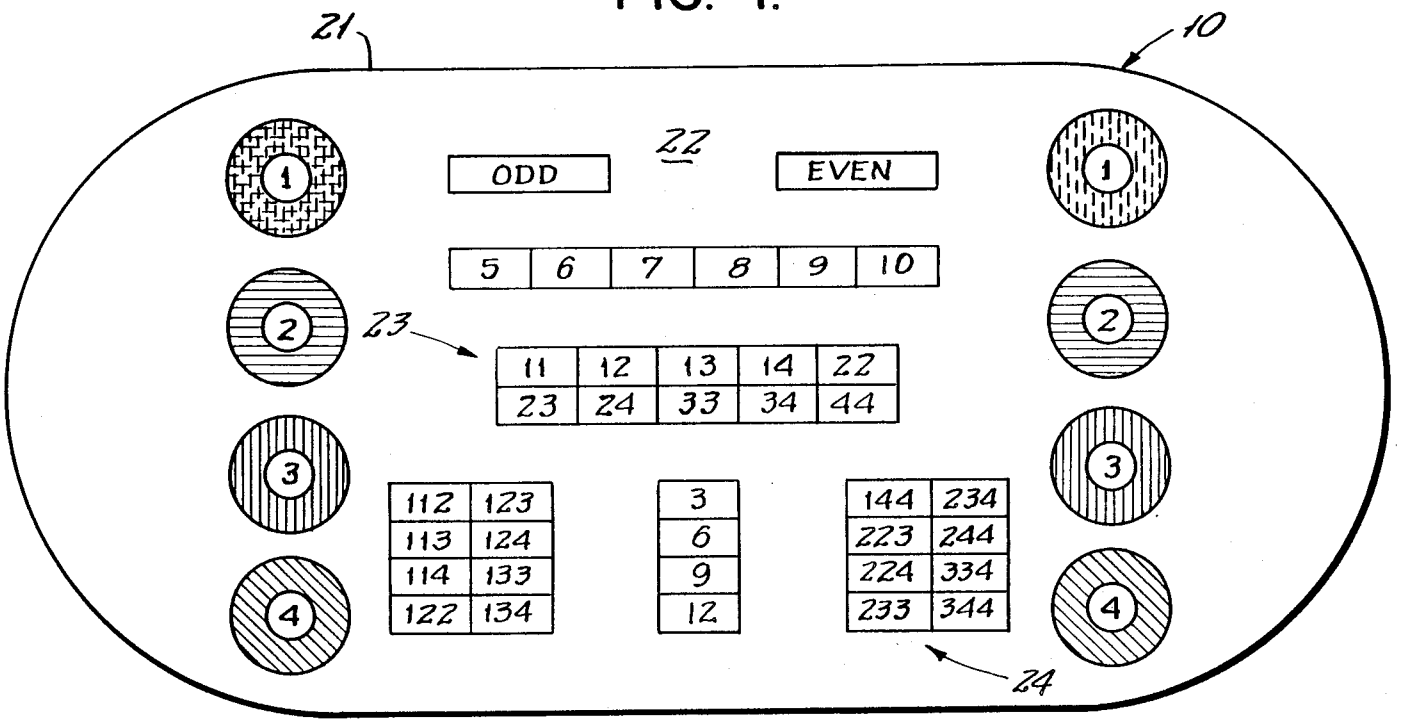
FIG. 1 is a plan view of a playing board forming a part of the disclosed embodiment.
Figure 3:
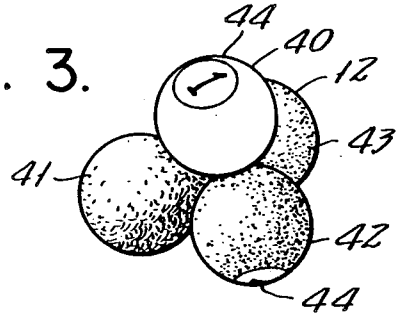
FIG. 3 is a perspective view of a second type of die forming a part of the embodiment.
Figure 2:
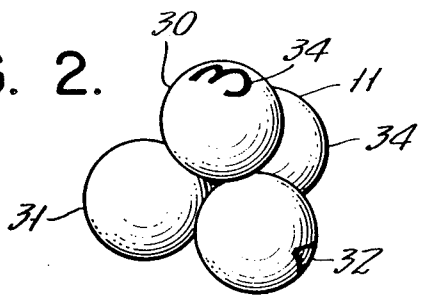
FIG. 2 is a perspective view of a first type of die forming part of the embodiment.

In accordance with the invention, the device or equipment comprises broadly: a playing board 10, a plurality of first dice 11, and a single second die 12.

The playing board 10 may be of any suitable construction, depending upon considerations of cost and frequency of use, and includes a periphery 21 enclosing a playing surface 22 displaying first roll betting areas 23 and second roll betting areas 24.

The dice 11 are similar, and are preferably of quadrahedron type including four spherical members 30, 31, 32 and 33, each of which bears a single digit in digit 34. The spherical members are interconnected in close proximity such that the die will always come to rest with one sphere facing upwardly.

The single second die 12 is of similar construction, including juxtaposed spherical members 40, 41, 42, and 43. Each is painted a different color, as for example, red, yellow, green and blue, and, in addition, is provided with a single digit 44 which corresponds to one of the digits on each of the first dice.

Where the game is played in a casino, it will normally be controlled by the croupier, and is commenced on his signal. When a round starts, bets may be placed anywhere on the board on any of the above described variables. When all bets have been made, the two white dice are handed to a first player to be rolled. The only bets determined by the first roll are the values which may be obtained from the first dice, namely 11, 12, 13, 14, 22, 23, 24, 33, 34, and 44. To win, the numbers must match the numbers on the dice. The croupier then collects and distributes chips won and lost on the first roll.

The only bets that can be made after the first roll is completed relate to the color and number of the third die, which has yet to be rolled. The second roll, which consists of the third and final die only, will determine the outcome of the rest of the wagering. The bets yet to be determined include: odd/even; hard 3,6, 9 and 12; the total numerical value of the three dice; the listed numbers shown on each die in any possible combination (for example, 2, 2 and 3 equals 223); and the color and number shown on the final die. The final roll is then made and the round completed. After the final roll is made, the croupier will once again distribute the chips won or lost, following which new bets are placed and the game continued.

It will be observed that bets will be placed in six individual areas of chance, only some of which are related to the color indicated by the final die. Other variations, including the provision of additional dice are possible, within the spirit and scope of the invention.

I wish it to be understood that I do not consider the invention limited to the precise details of structure set forth in this specification, for obvious modifications will occur to those skilled in the art to which the invention pertains.

I claim:

1. A dice game employing two mono-colored dice having four sides, each side being numbered from 1 to 4, and a single third die having four sides, each side having a different color and a single numerical value from 1 to 4, the playing of the game including the steps of:

(a) placing initial bets on numerical combinations of 11, 12, 13, 14, 22, 23, 24, 33, 34, and 44;

(b) making a first roll of the mono-colored dice to obtain an indicated numerical value corresponding to one of the values recited in the proceeding steps;

(c) placing secondary bets on any of the following conditions and values, including odd/even, hard 3, 6, 9 and 12; the total value of the three dice; the combinations possible from the values of the rolled three dice; and the color and number of the third die;

(d) making a second roll using only the third die; and (e) rewarding the players in accordance with attained bets.

2. A dice game in accordance with claim 1, wherein the dice are of quadrahedral type.

* * * * *